United States Patent [19]

Bassani et al.

[11] 4,224,724

[45] Sep. 30, 1980

[54] SYSTEM FOR OPENING FABRICS IN ROPE-FORM

[76] Inventors: Mariano Bassani, Via Trento, Trieste 7, Arcore, Milan; Mario Bianco, Loc. Vaccheria, 7/2, Alba (Cuneo), both of Italy

[21] Appl. No.: 906,412

[22] Filed: May 16, 1978

[30] Foreign Application Priority Data

Jun. 15, 1977 [IT] Italy ..... 68386 A/77

[51] Int. Cl.[2] ..... D06C 3/06

[52] U.S. Cl. ..... 26/75; 26/105; 226/20

[58] Field of Search ..... 26/74, 75, 77, 105; 226/18, 19, 20

[56] References Cited

U.S. PATENT DOCUMENTS

| | | | |
|---|---|---|---|
| 1,347,714 | 7/1920 | Rowley | 26/105 X |
| 3,317,101 | 5/1967 | Himrod et al. | 226/19 |

FOREIGN PATENT DOCUMENTS

| | | | |
|---|---|---|---|
| 601342 | 7/1960 | Canada | 226/19 |
| 449716 | 1/1913 | France | 26/105 |
| 2223992 | 10/1974 | France | 26/77 |
| 853 | of 1855 | United Kingdom | 26/105 |
| 4368 | of 1877 | United Kingdom | 26/74 |
| 16137 | of 1890 | United Kingdom | 26/105 |

OTHER PUBLICATIONS

*FIFE Automatic Guiding Systems,* FIFE Corporation, Oklahoma City, Oklahoma, 1005 R976, 16 pages.

*Scroll Openers Lam 13/1, Lam 13/2, Lam 13/2B,* Batson Machinery Inc., Greenville, S.C., 2-04, 10.000-4E, 2 pages.

*IMMS Scroll Roll Pack,* Speizman Industries, Inc., Charlotte, N.C., 2 pages.

*Primary Examiner*—Robert Mackey

*Attorney, Agent, or Firm*—Young & Thompson

[57] ABSTRACT

A system for opening fabrics in rope-form comprises a combination of a spreader device, and a centering device downstream of the spreader device a distance of 250 to 750 mm. The spreader device comprises two double spirally scored spreader rolls rotatably driven in the opposite direction to the fabric feed direction. The centering device comprises a pair of parallel centering rolls with means to vary their inclination to the direction of movement of the fabric, as needed.

6 Claims, 3 Drawing Figures

SYSTEM FOR OPENING FABRICS IN ROPE-FORM

This invention relates to systems for opening fabrics in rope-form.

In producing a system which is both functional and completely reliable, the invention provides a system for opening fabrics in rope-form, the main characteristic of which is that it comprises in combination:

(a) a spreader device comprising a structure supporting at least two double spirally scored spreader rolls rotatably driven in the opposite direction to the fabric feed direction and with their axes parallel, and means for angularly displacing said structure in such a manner as to vary the angle of inclination of the plane containing the axes of the spreader rolls;

(b) a centering device disposed at a predetermined distance downstream of the spreader device and comprising:

a structure supporting at least two centering rolls disposed with their axes parallel and lying in a plane substantially parallel to the fabric feed axis;

said structure being hinged at its ends, about axes perpendicular to the plane containing the axes of the centering rolls, to two slides displaceable along two axes contained in a plane parallel to the aforesaid plane and converging towards the fabric feed axis downstream of the centering rolls;

sensor means sensitive to changes in the direction of the fabric downstream of said rolls, and actuator means controlled by said sensor means and arranged to displace one of the slides in such a manner as to vary the inclination of the axes of the centering rolls between a central position in which said axes are perpendicular to the fabric feed axis, and two end positions in which said axes are equally inclined to said axis but in opposite directions.

The invention will be described hereinafter with reference to the accompanying drawings provided by way of non-limiting example, in which.

Figure 1:
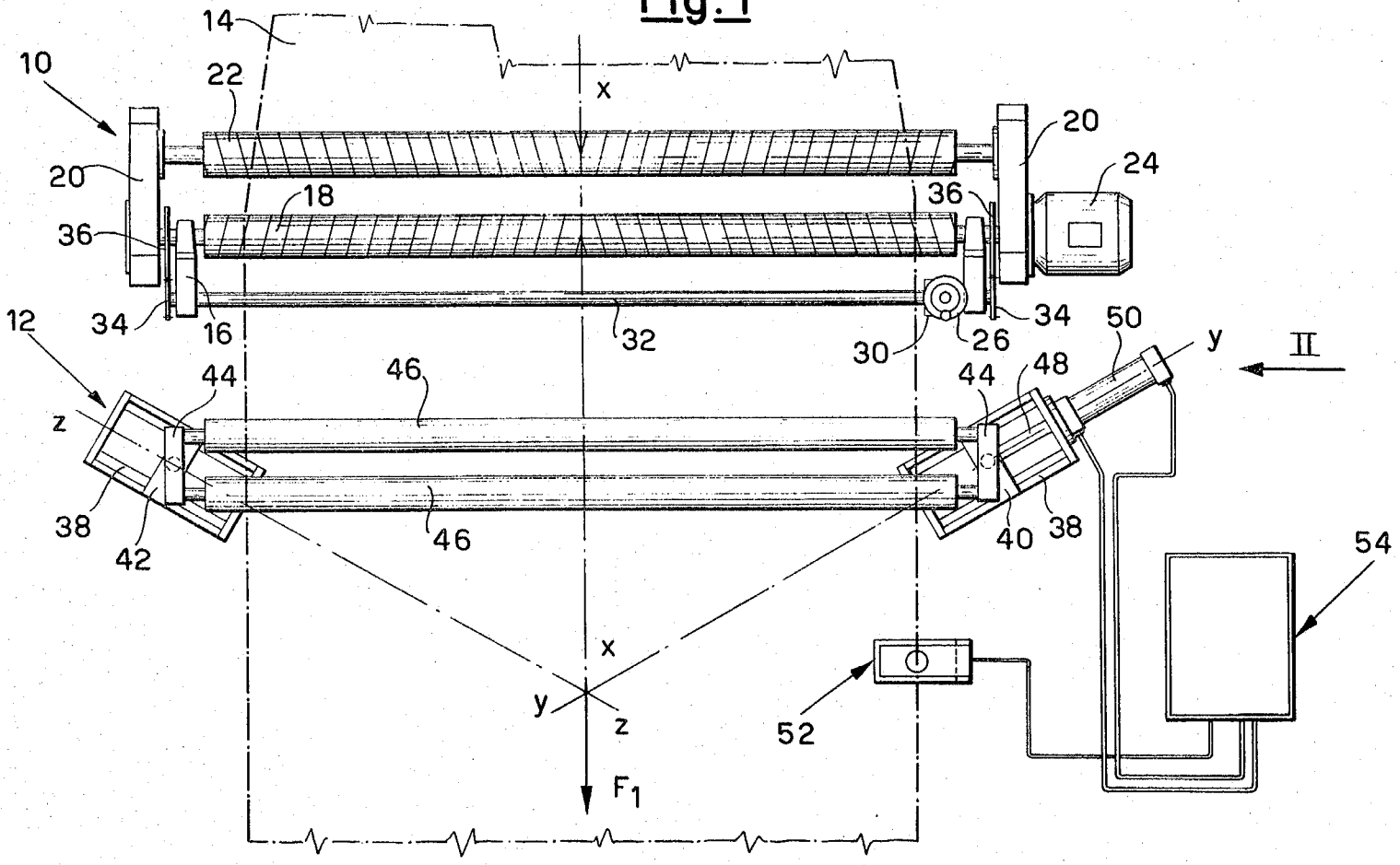
FIG. 1 is a partially diagrammatic elevation of the system according to the invention.

The reference numeral 10 indicates generally a spreader device downstream of which there is disposed a centering device 12, both designed to act on a fabric in rope-form 14 to be opened.

Two fixed uprights of a support frame are indicated by the reference numeral 16, and have rotatably mounted therein the ends of a double spirally scored spreader roll 18. Two support structures 20 are rotatably to said uprights 16 about an axis coinciding with the axis of the roll 18, and are displaceable angularly about said axis. The ends of a second double spirally scored spreader roll 22 with its axis parallel to the axis of the roll 18 are rotatably mounted in said support structures. A motor 24 fixed to one of the support structures 20 rotates the spreader rolls 18 and 22 via a reduction drive contained in the support structures 20.

The support structures 20 are displaced angularly by operating a handle 26 which rotates a bevel gear 28 engaging with a second bevel gear 30 keyed on a countershaft 32 rotatably mounted in the two uprights 16 in a position parallel to the axes of the spreader rolls 18 and 22. Two gear wheels 34 engaging with toothed sectors 36 rigid with the support structures 20 are mounted on the ends of the countershaft 32.

The centering device 12 is disposed downstream of the spreader device 10 at a predetermined distance therefrom. Preferably this distance lies between 250 mm and 750 mm.

With reference to the centering device 12, the reference numeral 38 indicates two fixed guides on which two slides 40 and 42 are mounted displaceable along an axis y—y and an axis z—z contained in a substantially vertical plane and converging towards the fabric feed axis x—x downstream of the device 12. The ends of a structure 44 supporting two centering rolls 46, disposed with their axes parallel and lying in a substantially vertical plane, are hinged to the slides 40 and 42. The slide 40 is connected to the rod 48 of a jack 50.

The reference numeral 52 indicates a photoelectric sensor for sensing the position of the selvedge of the fabric 14, and connected electrically to a unit 54 which processes the signal from the sensor and feeds it as a control signal to the jack 50.

Instead of being of photoelectric type as shown, the sensor could be of any other type, for example mechanical or pneumatic.

The operation of the system for opening fabric in rope-form 14 heretofore described is as follows.

After being collected in rope-form for undergoing finishing operations such as dyeing, bleaching and washing, the fabric 14 is fed through the spreader device 10 and centering device 12 by a traction system (not shown and disposed downstream of said devices) which conveys it forwards in the direction indicated by the arrow $F_1$ of FIG. 1 parallel to the x—x axis.

Figure 2:
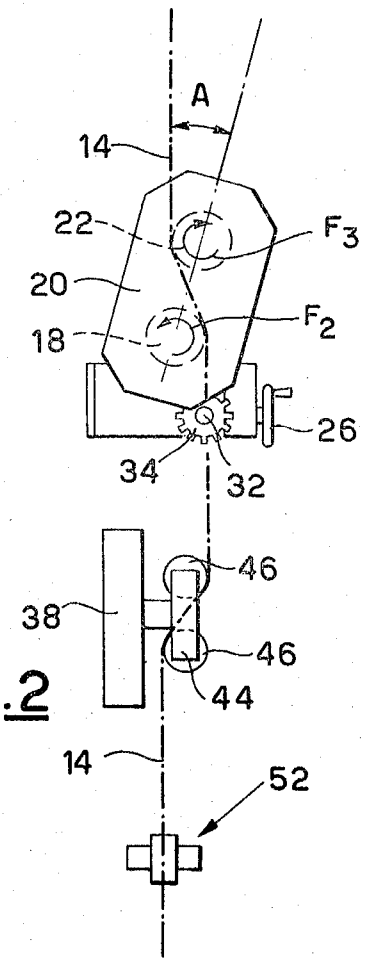
FIG. 2 is a diagrammatic side view of the system in the direction of the arrow II of FIG. 1.
Figure 3:
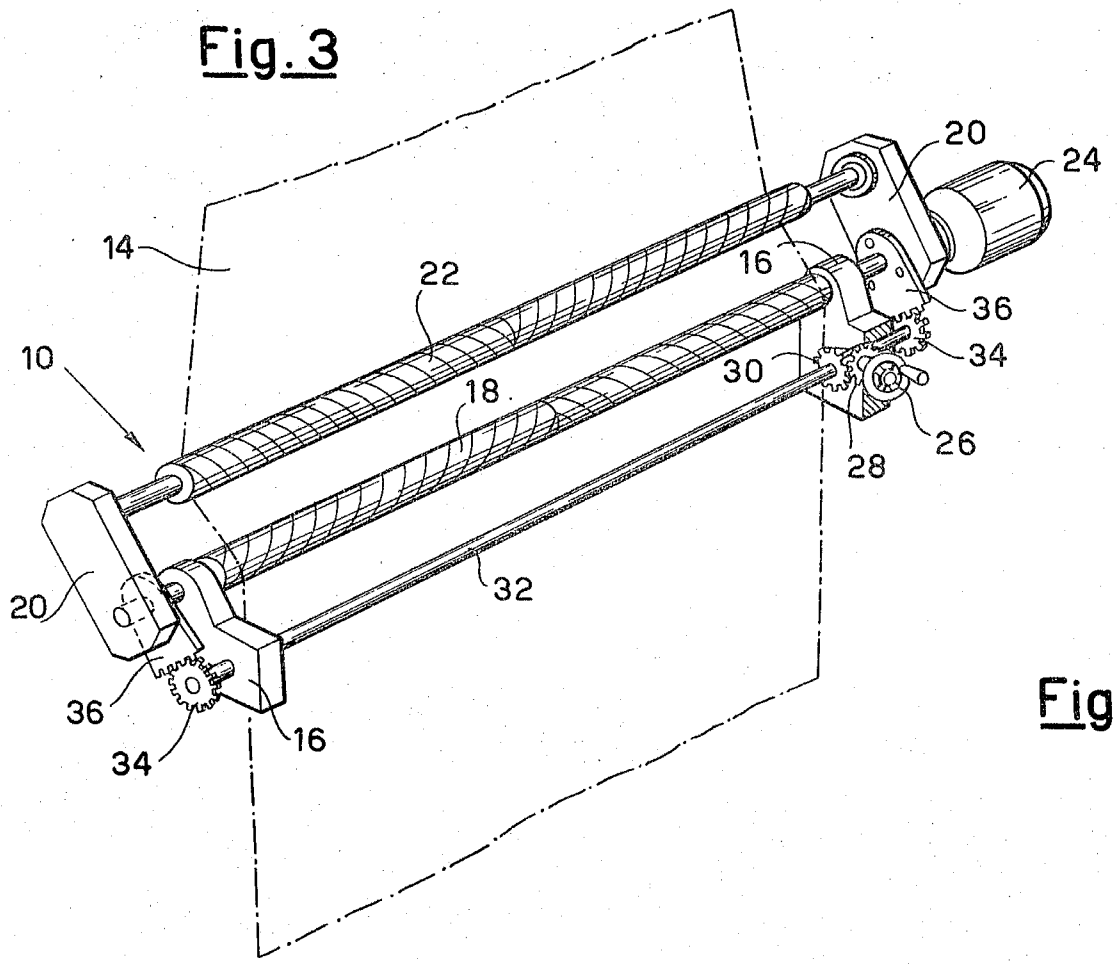
FIG. 3 is a perspective diagrammatic view of a component element of the system.

As shown in FIG. 2, the feed plane for the fabric 14 coincides substantially with the vertical plane. In the spreader device 10, the fabric 14 passes under friction through the spreader rolls 18 and 22 which are rotated in directions opposite to the fabric feed direction. The two directions of rotation of the rolls 18 and 22 are indicated respectively by the arrows $F_2$ and $F_3$ in FIG. 2. In this manner, because of their double spiral scoring, the spreader rolls 18 and 22 restore the fabric 14 to its widened form. The friction under which the fabric 14 passes in contact with the spreader rolls 18 and 22 can be varied by varying the angle of inclination (indicated by A) of the plane containing the axes of the spreader rolls to the vertical plane. The angle A is varied by rotating the handle 26 which, by means of the drive comprising the bevel gears 28 and 30, causes the gear wheels 34 and the sectors 36 rigid with the support structures 20 supporting the spreader rolls 18 and 22 to rotate. The fabric 14 leaving the spreader device 10 in its widened form passes under friction between the rolls 46 of the centering device 12. If the sensor 52 senses a displacement of the fabric 14 in a direction transverse to the feed direction along the x—x axis, the unit 54 causes the jack 50 to displace the slide 40 together with the slide 42, which is rigid therewith via the structure 44. This displacement of the slides 40 and 42 means that the inclination of the axes of the centering rolls 46 varies between a central position in which they are perpendicular to the fabric feed axis x—x, and a lateral position in which these axes are inclined to the x—x axis so as to oppose the deviation of the fabric 14 from said feed axis x—x. In this manner, a return action is exerted by the centering rolls on the fabric 14 which tends to return it into the required feed position parallel to the x—x axis.

Within the principles of the invention, the constructional details and embodiments can be widely varied relative to that described and illustrated by way of non-limiting example, without leaving the scope of the present invention.

What we claim is:

1. A system for opening fabrics in rope-form, comprising in combination:

(a) a spreader device (10) comprising a structure (20) supporting at opposite ends thereof at least two double spirally scored spreader rolls (18, 22) rotatably driven in the opposite direction to the fabric (14) feed direction and with their axes parallel, and means (26, 34, 36) for angularly displacing said structure (20) in such a manner as to vary the angle of inclination of the plane containing the axes of the spreader rolls (18, 22);

(b) a centering device (12) disposed at a predetermined distance downstream of the spreader device (10) and comprising:

a structure (44) supporting at least two centering rolls (46) disposed with their axes parallel and lying in a plane substantially parallel to the fabric (14) feed axis (x—x);

said structure (44) being hinged at the ends about axes perpendicular to the plane containing the axes of the centering rolls (46), to two slides (40, 42) displaceable along two axes (y—y, z—z) contained in a plane parallel to the aforesaid plane and converging towards the fabric (14) feed axis (x—x) downstream of the centering rolls (46);

sensor means (52) sensitive to changes in the direction of the fabric (14) downstream of said rolls, and actuator means (50) controlled by sensor means (52) and arranged to displace one of the slides (40) in such a manner as to vary the inclination of the axes of the centering rolls (46) between a central position in which said axes are perpendicular to the fabric (14) feed axis (x—x), and two end positions in which said axes are equally inclined to said axis (x—x) but in opposite directions, the means for rotatably driving the spreader rolls (18, 22) comprising an electric motor (24) and a drive supported by one of the two support structures (20), the spreader device and the centering device being 250 mm to 750 mm apart.

2. A system as claimed in claim 1, wherein the spreader rolls (18, 22) are supported at their ends said two support structures (20) hinged to a fixed support frame (16) about an axis coinciding with the axis of one of the rolls (18).

3. A system as claimed in claim 2, wherein the means for angularly displacing the support structures (20) comprise a handle 26 which rotates a countershaft (32) supported by the fixed support frame (16) parallel to the spreader rolls (18, 22); said countershaft (32) displacing the support structures (20) via two end drives (34, 36).

4. A system as claimed in claim 1, wherein the sensor means comprise a sensor (52) for sensing the position of the selvedge of the fabric (14), and sensitive to the displacements of the fabric (14) in a direction transverse to the feed direction.

5. A system as claimed in claim 4, wherein the sensor (52) is of electrical type.

6. A system as claimed in claim 1, wherein the actuator means are of electro-mechanical type.

* * * * *